United States Patent [19]

Weschenfelder et al.

[11] 4,079,928

[45] Mar. 21, 1978

[54] METHOD AND APPARATUS FOR PRODUCTION OF THICK FOLDED PRODUCTS IN WED-FED ROTARY PRINTING PRESSES

[75] Inventors: Otto Theodor Weschenfelder, Wurzburg; Horst Bernhard Michalik, Hochberg, both of Germany

[73] Assignee: Koenig & Bauer Aktiengesellchaft, Wurzburg, Germany

[21] Appl. No.: 661,669

[22] Filed: Feb. 26, 1976

[30] Foreign Application Priority Data

Mar. 19, 1975 Germany ..... 2512017

[51] Int. Cl.[2] ..... B65H 5/30

[52] U.S. Cl. ..... 270/55

[58] Field of Search ..... 270/54–58, 270/4, 9, 18, 21, 5, 1, 4, 7; 271/64, 173

[56] References Cited

U.S. PATENT DOCUMENTS

| | | | |
|---|---|---|---|
| 556,409 | 3/1896 | Firm | 270/9 |
| 3,822,877 | 7/1974 | Littleton | 270/56 |
| 3,951,399 | 4/1976 | Reist | 270/58 |

FOREIGN PATENT DOCUMENTS

| | | | |
|---|---|---|---|
| 2,513,244 | 10/1975 | Germany | 270/21 |

*Primary Examiner*—Edgar S. Burr
*Assistant Examiner*—A. Heinz
*Attorney, Agent, or Firm*—Jones, Tullar & Cooper

[57] ABSTRACT

A method and apparatus for producing thick folded products such as newspapers having upwards of 100 pages is disclosed. Web-fed rotary printing presses deliver their printed webs to suitable folding means which, in turn, deliver synchronous streams of folded sections to an associating means where a second folded section is associated with, or inserted into, a first section thus forming a complete product such as a newspaper.

1 Claim, 2 Drawing Figures

METHOD AND APPARATUS FOR PRODUCTION OF THICK FOLDED PRODUCTS IN WED-FED ROTARY PRINTING PRESSES

FIELD OF THE INVENTION

The present invention is directed to a method and apparatus for the production of thick folded paper products such as newspapers in web-fed rotary printing presses.

DESCRIPTION OF THE PRIOR ART

Apparatuses for the production of thick folded products, for example, newspapers, have become known from, for example, German Pat. No. 1,761,074. In this specification, so-called cylinder folders are described which are capable of producing newspapers up to 144 pages. As a common practice, up to nine double width paper webs are longitudinally slit and are associated by means of formers to produce 36 partly longitudinally folded paper strips. The folder then crosscuts these 36 paper strips, deposits each of the cut-off strips in a known collecting operation upon the following stack, and then crossfolds these 72 papers. Folding is thus executed in the folder in a single operation for all pages of the thick newspaper.

It is a disadvantage of this known method that all the 72 pages must be crossfolded in a single operation. Accordingly, the folding forces are extremely high and it is very difficult to produce newspapers of even greater thickness, because the common operations of cutting, collecting, and crossfolding become more and more difficult when applied to thicker products.

Another disadvantage of the known method of folding extremely thick newspapers is that previously only the cylinder fold principle could be utilized therefor. With the cylinder fold principle, however, a sudden reverse direction of motion of the newspaper copy occurs in the folding operation which results in a "whip effect". By this effect, the copies are liable to become damaged and under certain circumstances they may undergo torn corners, torn pin holes, or other damage such as tears, dog ears, or creases.

An alternate known method used to produce thick newspapers is by pre-production of folded sections which are then associated outside of the rotary printing presses by hand or by means of mechanical inserting machines. There are, however, disadvantages particularly in the production of extremely long runs due to the floor space required and the expenditure of work for intermediate piling of the preproduced sections. In addition, this method of inserting the sections requires a large expenditure of personnel or machines.

SUMMARY OF THE INVENTION

It is accordingly an object of the present invention to provide a method and apparatus to produce extremely thick folded products at maximum speed without damaging each folded product to the extent hitherto tolerated and without the expenditure of a large amount of time or the use of a large number of people.

According to the invention and apparatus, there is provided a method for the production of thick folded products which is comprised of a plurality of web-fed rotary printing presses, folding means for the production of a plurality of synchronous streams of folded web sections, and gathering means for associating the folded web sections to form complete folded products.

The advantages obtained from the invention consist particularly in that the apparatus according to the invention is capable of dispensing with the cylinder fold principle with its disadvantageous "whip effect". As a result of the association of two synchronously fed streams of copies, for example, to form a newspaper of 144 pages, only two folded sections of 72 pages are required. For newspapers of 160 pages, two associated sections of 80 pages each are sufficient. Sections of 80 pages, however, can still be produced very well by means of the jaw folding principle.

One of the advantges of the jaw folders is that in the case of change of speed, no overlapping or underlapping fold is effected. Besides, the folded product receives in the first cross folding process a sharp fold. Processing of the folded products on mailing or processing lines is thus facilitated due to the sharp fold.

In accordance with the present invention, a web-fed rotary printing press is preferably utilized with printing units, on the forme cylinders of which four plates instead of the usual two are arranged on the periphery. Preferably in such a web-fed rotary printing press six such sets of four plates are arranged side by side on the forme cylinders instead of four sets of plates so that three fed-in paper webs have a total page capacity of 144 pages.

In one example of apparatus constructed according to the invention, the folding apparatus for thick products is constructed as a so-called jaw folding apparatus capable of longitudinally folding, cutting, collecting, and crossfolding in a known manner. The folding apparatus is preferably constructed as a so-called splitfolder, being capable of depositing non-collect production as well as single-collect production on two output deliveries. Both deliveries are connected with known conveyor means, such as endless conveyor belts, which transfer both streams of folded products for further treatment.

For the production of thick folded products, the first folded section of the product, that is the section with the pages numbered from 1 to 72, is transferred onto the first delivery, and the second section of the product, comprising pages numbered from 73 to 144 is transferred onto the second delivery conveyor. These two folded sections are associated by means of an apparatus behind both deliveries for the association of folded sections such that a newspaper of 144 pages is produced. It is advantageous to attach such an apparatus directly to the folding apparatus.

Preferably the apparatus for the association of folded sections consists in a known rotating drum having a plurality of compartments into which both folded sections are transferred side by side. Lateral shifting means are provided and insure that the several folded sections are associated so as to form a complete folded product. This association drum is preferably located, as already discussed, spaced at a short distance from both delivery conveyors, and by means of short conveyor belts the streams of folded sections are guided initially one above the other, are then laterally beside each other so as to lie side by side and on the same level. In this position they are then fed into the association drum.

It is an advantage of the present invention that no extremely high output speed is required from the apparatus for the association of folded sections. It is required only for the production of extremely thick newspapers, for which both synchronous streams of sections are no longer conveyed at double production speed, but only at the speed of collect production. Starting the calculation, for example, from a known high-speed web-fed rotary printing press with an hourly output of 100,000 newspapers in non-collect production, both deliveries supply, due to the utilization of a split folder, 50,000 newspapers per hour. If the web-fed rotary printing press is to produce extremely thick folded products, the streams of folded sections are fed into the apparatus for the association of folded products. In this case the web-fed rotary printing press runs in single-collect production, producing 50,000 sections per hour, or in other words, each delivery produces 25,000 sections per hour. Thus, a maximum of only 25,000 sections per hour are transferred into each compartment of the association drum. Due to the association of both sections in the apparatus for the association of folded products, double-thick folded products are produced therefore at a speed of 25,000 products per hour.

It is to be understood that the production of streams of folded sections in accordance with the invention is not limited to so-called split folding apparatus. On the contrary, both streams of folded sections can alternatively be produced in a double folding apparatus which is run in coupled operation. In this case, either stream of folded sections is conveyed into one of the folders. It is, however, also possible to produce synchronously running streams of folded sections from two spaced apart folders of one coupled complete machine installation. In this case, known newspaper conveyor installations must be provided as intermediate links between the folders and the apparatus for the association of folded sections.

For the production of synchronously running streams of folded sections according to the invention, a double width folding apparatus may also be utilized in which both different folded sections are deposited widthwise and are transferred into the compartments of the apparatus for the association of folded sections. It is an advantage of the direct connection of the apparatus for the association of folded sections to the folding jaw cylinder or by means of an intermediate gripper drum, that the formation of a stream of overlapped folded sections between the folder delivery and the apparatus for the association of folded sections is prevented. If the folded sections are removed from the folding jaws, for example, by means of known gripper cylinders rotating at a reduced speed by so-called slow-down cylinders, and are immediately transferred into the compartments of the apparatus for the association of folded sections, a completely precise synchronous course of every folded section into the apparatus for the association of folded sections is insured.

As already mentioned above, the apparatus for the association of folded sections is preferably constructed as a rotating drum. The apparatus for the association of folded sections according to the invention is not limited, however, to this type of construction, and other rotary types of construction may be utilized.

BRIEF DESCRIPTION OF THE DRAWINGS

While the novel features of the present invention are set forth with particularity in the appended claims, a more full and complete understanding of the invention may be had from the description of a preferred embodiment as set forth hereinafter, and as shown in the accompanying drawings in which:

DESCRIPTION OF A PREFERRED EMBODIMENT

Figure 1:
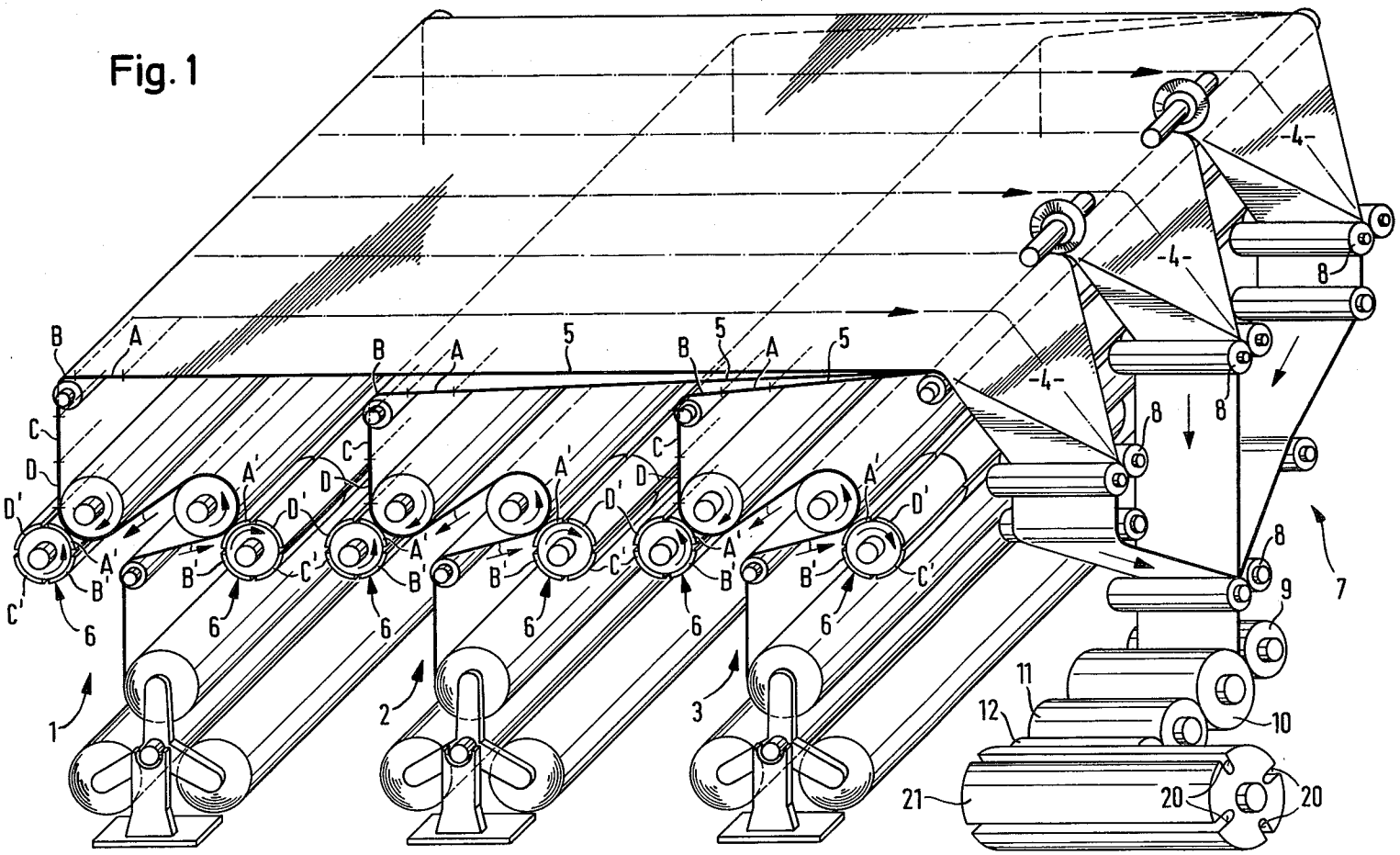
FIG. 1 is a perspective side view of the apparatus in accordance with the present invention.
Figure 2:
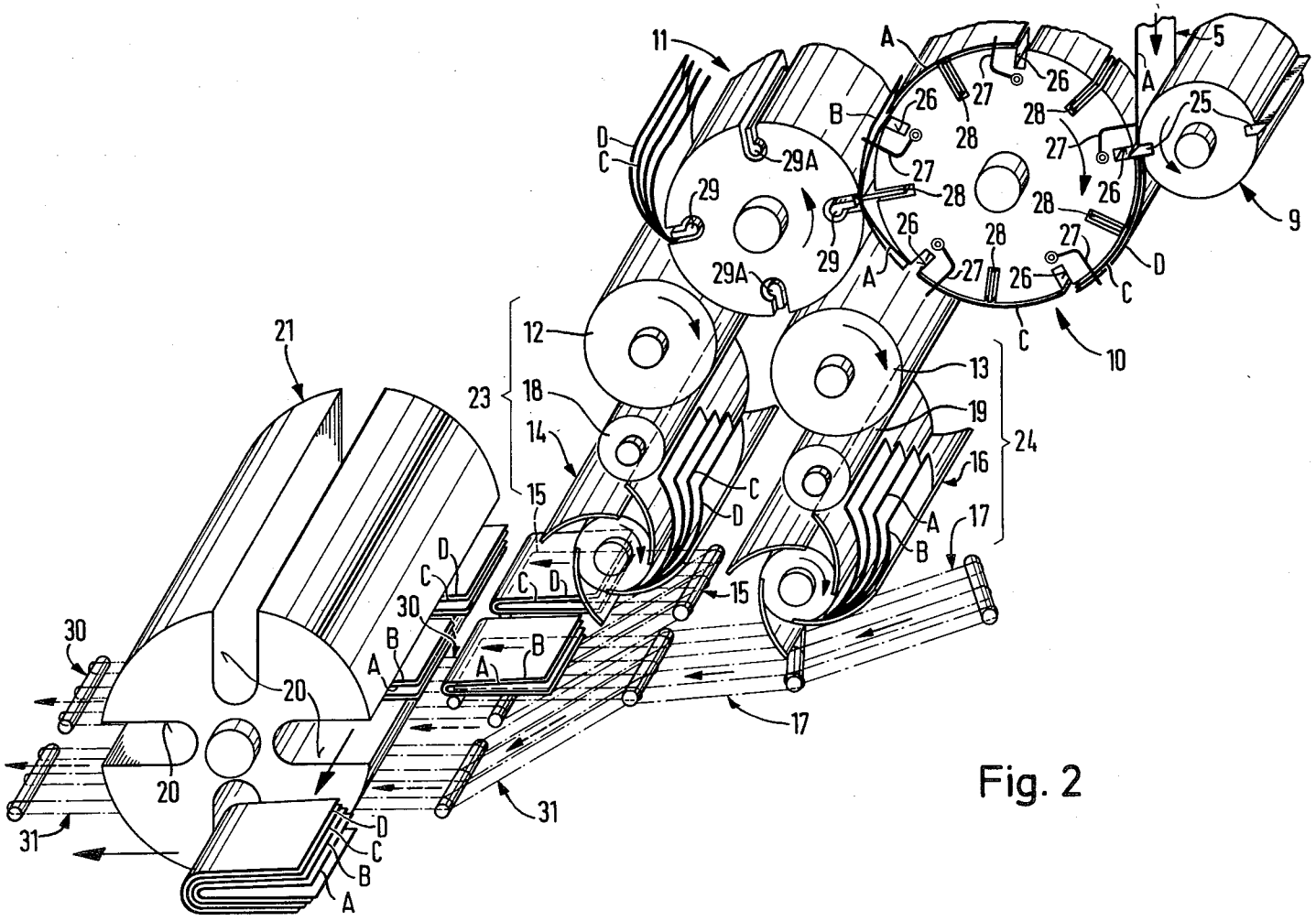
FIG. 2 is a perspective side view of the folding and associating drum portions of the invention with two deliveries cooperating with an apparatus for the association of the folded sections.

FIG. 1 shows three paper webs 5 being conveyed from the three printing units 1, 2, 3, being longitudinally slit, and entering into the folding apparatus 7 with its three formers 4. The forme cylinders 6 of printing units 1, 2, 3 are preferably of double size and each forme cylinder bears four printing plates A', B', C', D' on its periphery. Each of the printing plates A', B', C', D' prints one newspaper page A, B, C, D, respectively and covers 90° of the periphery of the forme cylinder 6. Thus four newspaper pages are located in the periphery one behind the other, and instead of the four printing plates located side by side as hitherto usual, preferably six printing plates are located side by side on each forme cylinder 6. In the folding apparatus 7, the longitudinally slit paper strips conveyed from the three formers 4 are associated and are transferred by feed roll groups 8. A 2/2 cutting cylinder 9; i.e., a cutting cylinder 9 having a periphery divided into two parts which are both twice the width of the page of the newspaper being printed, equipped with two cutting knives 25 as may be seen in FIG. 2, cuts the paper webs 5 to page size segments working against a 5/2 counter-cut groove and collecting cylinder 10; i.e., a cylinder 10 having a periphery divided into five parts which are all twice the width of the newspaper being printed. Cylinder 10 is equipped with five counter-cut grooves 26, five controlled series of pins 27, and five controlled folding blades 28. A 4/2 folding jaw cylinder 11; i.e., a cylinder 11 having a periphery divided into four parts which are all twice the width of the page of the newspaper being printed, cooperates with the 5/2 counter-cut groove and collecting cylinder 10. Cylinder 11 is equipped with two controlled paper folding jaws 29 and two juxtaposed folding jaws 29A which are not used in collect production. A left-side slow-down cylinder 12 and a right-side slow-down cylinder 13 are coordinated to the 4/2 folding jaw cylinder 11. By means of a left-side fan 14, a folded section DC is deposited on a left-side conveyor means 15, while a right-side fan 16 deposits the folded section BA on a right-side conveyor means 17. As may be seen in FIG. 2, right-side conveyor 17 is angled laterally with respect to left-side conveyor 15 so that the folded sections BA deposited on conveyor 17 are separated laterally from the folded sections DC deposited on conveyor 15 to provide two synchronous streams of series of folded sections. Transfer cylinders 18 and 19 are arranged between the slow-down cylinders 12 or 13, and the fans 14 or 16. By means of the conveyor means 15 and 17, the folded sections DC and BA are conveyed into the same compartment 20 of a rotating drum 21. A suitable rotating drum assembly 21 may be seen in U.S. Pat. No. 3,951,399 to Reist and in German Offenlegungsschrift No. 2,447,336, in French Pat. No. 2,247,408, and in Belgian Pat. No. 820,865. In the compartment 20, the folded sections DC are opened and the folded sections BA are slipped into the opened folded sections DC, and the associated sections are transferred at the appropriate time by appropriate means to a conveyor means (not shown in the drawings) as a folded product DCBA. The drum 21 is driven to rotate synchronously with the streams of the folded sections. Further conveyor means 30, 31 lead from the deliveries 23 and 24 into the forwarding department, and in the case of non-collect and single-collect production are connected directly with the folding apparatus. For these types of production, the drum 21 or other apparatus for the association of folded sections is not used. Both deliveries 23 and 24 convey the produced folded products by means of conveyor means 30, 31, directly to the forwarding department.

The folded sections BA and DC are produced by the printing plates A', B', C', D' which produce prints A and B and C and D on the pertaining paper webs 5. To simplify matters, each paper web is printed on the opposite sides with the same prints A—A, B—B, C—C, D—D. The cross-cut copies cut from one sheet, A, B, C, D are grasped non-collected or single-collected according to the type of production, by the 5/2 counter-cut groove and collecting cylinder 10 by means of its series of pins 27. Folding blades 28 push the collected or non-collected copies into the folding jaws 29 of the 4/2 folding jaw cylinder 11. Thus, the cross-cut copies are converted to folded sections; and in collect production, to the folded sections DC and BA.

The folded sections DC, BA pass from slow-down cylinders 12, 13, equipped with two sets of gripper series displaced at 180°, via transfer cylinders 18, 19 into fans 14, 16. These fans deposit the folded sections DC, BA, as mentioned above, onto the conveyor means 15, 17.

Transfer cylinders 18, 19 may be omitted so that the appratus for the association of folded sections is fed directly; i.e., without conveyor means, from the slow-down cylinders 12, 13. It is also possible to omit the slow-down cylinders 12 and 13, and the transfer cylinders 18 and 19.

The various types of folding apparatuses and folder combinations mentioned in the description of the invention, such as coupled double folding apparatus, double-width jaw folding apparatus, or two coupled operating folding apparatuses, are not shown in the drawings because knowledge of such apparatuses may be expected from an average skilled person. Further, reference may be had to the following U.S. Patents which show these various apparatuses; U.S. Pat. No. 2,019,658 to Crafts, U.S. Pat. No. 2,797,089 to Hilgoe, U.S. Pat. No. 2,842,360 to Crafts, and U.S. Pat. No. 3,459,421 to Motter.

As already mentioned above, to achieve the object of the invention, it is advantageous to utilize a printing unit with forme cylinders each of which bears four printing plates in its periphery and six printing plates along its width. This construction offers the advantage that only few paper webs must be used. It is, however, also possible to utilize printing units equipped with forme cylinders bearing, as in common practice, only two printing plates each in the periphery and four plates each side by side.

While a preferred embodiment of the subject invention has been fully and completely disclosed above, it will be apparent that a number of changes could be made without departing from the spirit and scope of the above-described invention and that the invention is limited only by the appended claims.

We claim:

1. A method for producing thick folded products, said method including the steps of:

producing a plurality of printed webs on web-fed rotary printing units, each of said printing units having formed cylinders which carry printing plates thereon;

feeding said printed webs to a cutting cylinder and counter-cut groove and collecting cylinder to cut said printed webs into a plurality of segments;

transferring said segments to a folding jaw cylinder to fold said segments into a series of folded sections;

separating said series of folded sections into at least two synchronous streams; and immediately inserting one of said folded sections from a first of said synchronous streams within a corresponding one of said folded sections from a second of said synchronous streams to form one of said thick folded products.

* * * * *

UNITED STATES PATENT AND TRADEMARK OFFICE

CERTIFICATE OF CORRECTION

PATENT NO. : 4,079,928

DATED : March 21, 1978

INVENTOR(S) : Otto Theodor Weschenfelder; Horst Bernhard Michalik

It is certified that error appears in the above-identified patent and that said Letters Patent are hereby corrected as shown below:

IN THE CLAIMS

Claim 1, line 5, "formed" should be --forme--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*